US007292149B2

(12) United States Patent
Yasur et al.

(10) Patent No.: US 7,292,149 B2
(45) Date of Patent: Nov. 6, 2007

(54) ELECTRONIC MONITORING DEVICE

(75) Inventors: Shlomo Yasur, Tel Aviv-Yafo (IL); Mathiew Bais, Southlake, TX (US)

(73) Assignee: Elpas Electro-Optic Systems, Ltd., Southlake, TX (US)

( * ) Notice: Subject to any disclaimer, the term of this patent is extended or adjusted under 35 U.S.C. 154(b) by 221 days.

(21) Appl. No.: 11/082,115

(22) Filed: Mar. 16, 2005

(65) Prior Publication Data

US 2006/0220880 A1 Oct. 5, 2006

(51) Int. Cl.
*G08B 23/00* (2006.01)

(52) U.S. Cl. ..... 340/573.1; 340/572.1; 24/68 R

(58) Field of Classification Search ..... 340/573.1, 340/572.1–572.9, 573.4, 5.81; 24/68 R, 24/18

See application file for complete search history.

(56) References Cited

U.S. PATENT DOCUMENTS

| | | | | |
|---|---|---|---|---|
| 3,921,321 | A | 11/1975 | Baessler | 128/2 H |
| 3,972,320 | A | 8/1976 | Kalman | 128/2.1 A |
| 4,694,284 | A | 9/1987 | Leveille et al. | 340/574 |
| 4,814,751 | A | 3/1989 | Hawkins et al. | 340/573 |
| 4,853,692 | A | 8/1989 | Wolk et al. | 340/573 |
| 4,924,211 | A | 5/1990 | Davies | 340/573 |
| 4,952,913 | A | 8/1990 | Pauley et al. | 340/573 |
| 5,006,830 | A | 4/1991 | Merritt | 340/573 |
| 5,014,040 | A | 5/1991 | Weaver et al. | 340/572 |
| 5,047,750 | A | 9/1991 | Hector | 340/573 |
| 5,079,541 | A | 1/1992 | Moody | 340/573 |
| 5,189,396 | A * | 2/1993 | Stobbe | 340/541 |
| 5,218,344 | A | 6/1993 | Ricketts | 340/573 |
| 5,289,163 | A | 2/1994 | Perez et al. | 340/573 |
| 5,387,993 | A | 2/1995 | Heller et al. | 359/155 |
| 5,440,295 | A | 8/1995 | Ciecwisz et al. | 340/573 |
| 5,455,851 | A | 10/1995 | Chaco et al. | 379/38 |
| 5,457,440 | A | 10/1995 | Daddono | 340/573 |
| 5,504,474 | A | 4/1996 | Libman et al. | 340/572 |
| 5,512,879 | A | 4/1996 | Stokes | 340/573 |
| 5,552,771 | A * | 9/1996 | Leyden et al. | 340/568.2 |
| 5,578,989 | A | 11/1996 | Pedtke | 340/539 |
| 5,608,382 | A * | 3/1997 | Webb et al. | 340/573.4 |
| 5,610,587 | A * | 3/1997 | Fujiuchi et al. | 340/568.2 |
| 5,621,384 | A | 4/1997 | Crimmins et al. | 340/539 |
| 5,640,147 | A | 6/1997 | Chek et al. | 340/573 |
| 5,646,593 | A | 7/1997 | Hughes et al. | 340/573 |
| 5,652,569 | A | 7/1997 | Gerstenberger et al. | 340/573 |
| 5,689,229 | A | 11/1997 | Chaco et al. | 340/286.07 |
| 5,714,932 | A | 2/1998 | Castellon et al. | 340/539 |
| 5,722,266 | A * | 3/1998 | Yeager et al. | 70/57 |
| 5,745,037 | A | 4/1998 | Guthrie et al. | 340/573 |
| 5,751,214 | A | 5/1998 | Cowley et al. | 340/573 |
| 5,838,223 | A | 11/1998 | Gallant et al. | 340/286.07 |
| 6,104,295 | A | 8/2000 | Gassier et al. | 340/573.4 |
| 6,154,139 | A | 11/2000 | Heller | 340/573.4 |
| 6,225,906 | B1 | 5/2001 | Shore | 340/573.4 |
| 2001/0035824 | A1 | 11/2001 | Fourie et al. | 340/573.4 |

* cited by examiner

*Primary Examiner*—Phung T. Nguyen
(74) *Attorney, Agent, or Firm*—Marshall, Gerstein & Borun LLP

(57) ABSTRACT

The present disclosure provides for an electronic monitoring device having an adjustable length cable to connect the monitoring device to an object. A band is adapted to engage at least a portion of the object and is operable for receiving a portion of the cable therein. The band may include a winding mechanism connectable thereto which is adapted to wind a desired length of cable into the band such that the band and cable can be matched to the size of the object being monitored.

24 Claims, 11 Drawing Sheets

ELECTRONIC MONITORING DEVICE

FIELD OF THE DISCLOSURE

This patent relates to an electronic monitoring device attachable to an object, and more particularly to an electronic monitoring device that includes a winding mechanism to adjust the length of an attaching cable to correspond with the size of the object.

BACKGROUND OF THE DISCLOSURE

The abduction of infants from hospital maternity wards happens with alarming frequency. The incorrect matching of newborn infants and parents also occurs much too often. To ensure that mother and infant are correctly matched together, some hospitals use a system of coded badges that are secured to each of the mother and the infant. Typically, a multi-digit code is printed on a wristband which is secured to the mother, and a wrist and/or ankle band bearing a matching multi-digit code is secured to the infant. The mother's badge is secured prior to delivery, and the infant's badges are secured as soon as practical after delivery while both the mother and infant remain in the delivery room. When mother and infant are later united, for example when the infant is brought from the nursery to the mother's recovery room, a hospital staff member is instructed to verify the numbers match to ensure the correct infant is united with the correct mother. Mothers are also encouraged to check that the numbers match. As an alternative to the infant wrist or ankle band, it has been proposed to imprint the code on an umbilical clamp and to provide the mother with a wristband again bearing a matching code. It is suggested that the umbilical clamp system ensures that the coded band does not inadvertently detach itself from the infant. With either wrist/ankle bands or umbilical clamps, the system requires human intervention to function correctly, and errors in matching mother and infant can still occur if the hospital staff or the mother fail to check or are careless in checking that the coded numbers match.

In addition to infants, it may be desirable to monitor other objects such as household pets, wildlife, incarcerated prisoners, and the like. One invention has overcome some of the problems disclosed above. U.S. Pat. No. 6,211,790 discloses a infrared/radio frequency (IR/RF) transmitter/receiver operably secured to the mother and to the infant. In a matching mode of operation, IR signals are received by infrared receivers located within the various rooms of the hospital to precisely and automatically determine by proximity that mother and infant are correctly united. In a presence detecting mode, RF signals from the infant's badge are detected by RF receivers located throughout the maternity ward of the hospital or throughout the hospital generally. In a security mode, RF receivers located proximate exits of either of the maternity ward and/or the hospital detects RF signals from the infant and may provide a signal to generate an alarm if any unauthorized exit occurs.

In previous ankle and/or wrist tag devices, the band and cable length are adjusted to be fitted to the ankle or wrist and any excess material left is cut. Having to cut the excess using a scissors or a sharp object poses a risk to the infant and/or the nurse. The cut portion may also be left by mistake in the baby's bed, etc. presenting a choking hazard.

DETAILED DESCRIPTION

The present disclosure describes an electronic monitoring device having an adjustable length cable that is connectable around an object. A band is adapted to engage at least a portion of the object and is operable for receiving a portion of the cable therein. The band may include a winding mechanism connected thereto which may be adapted to wind a desired length of cable into the winding mechanism such that the band and cable can be sized to fit around the object.

Figure 1:
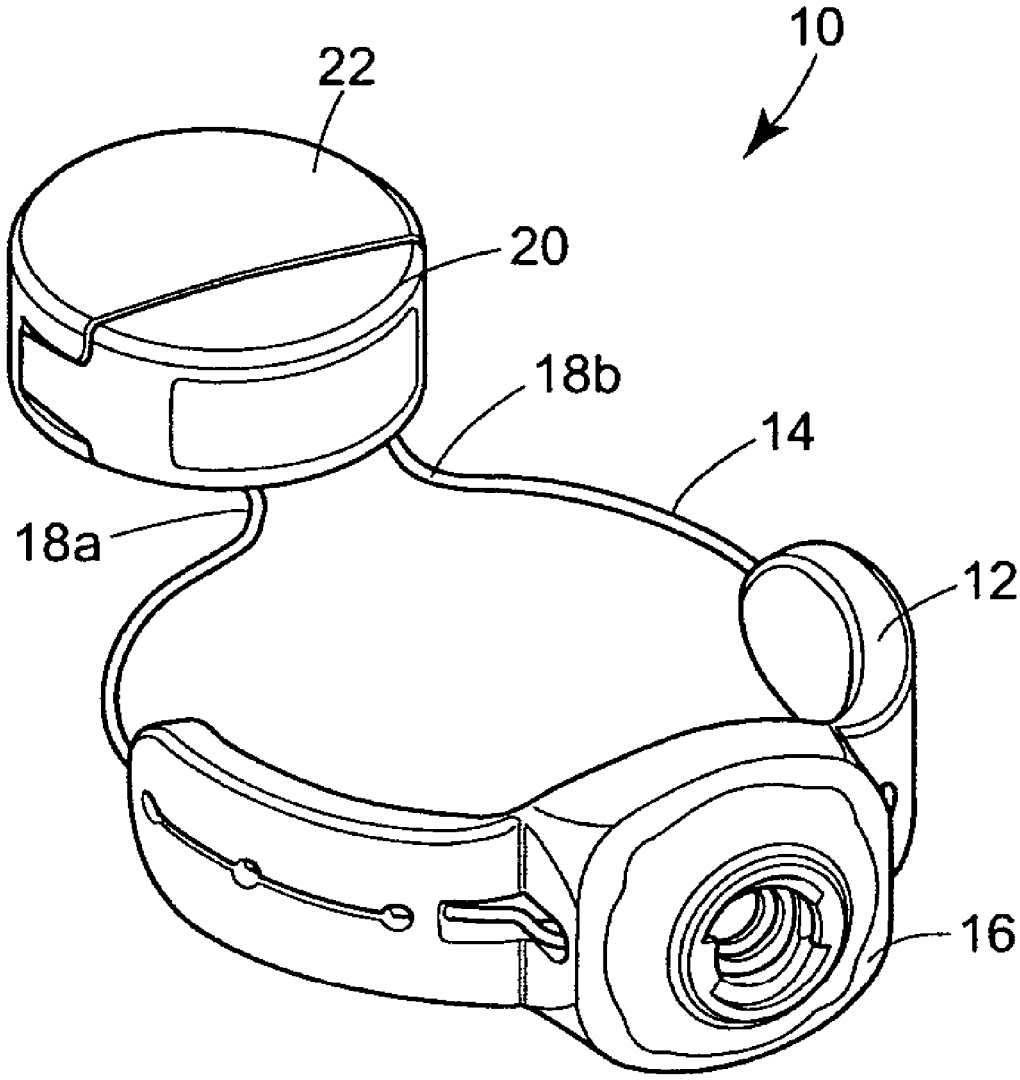
FIG. 1 is a perspective view of an electronic monitoring device.

FIG. 1 generally illustrates an electronic monitoring device 10. The electronic monitoring device 10 is attachable to any object desired, but in one particular embodiment the device 10 may be attached to an ankle of a newborn infant in a hospital or the like. The electronic monitoring device 10 may include a band 12 having an adjustable length cable 14 operably coupled therewith. The band 12 may include a winding mechanism 16 operable for winding a portion of the cable 14 therein to advantageously adjust the size of the band 12 and cable 14 assembly. The cable 14 includes a pair of opposing ends 18*a*, 18*b* that terminate within a cap 20. The cap 20 is adapted to receive and couple an electronic tag 22, which is operable for transmitting at least one electronic signal therefrom. The band is preferably made from a latex-free material so as not to cause skin irritations to individuals that have allergic reactions to latex material. The other components can be made from any of a variety of materials such as plastic, metal, composite and the like.

Figure 2:
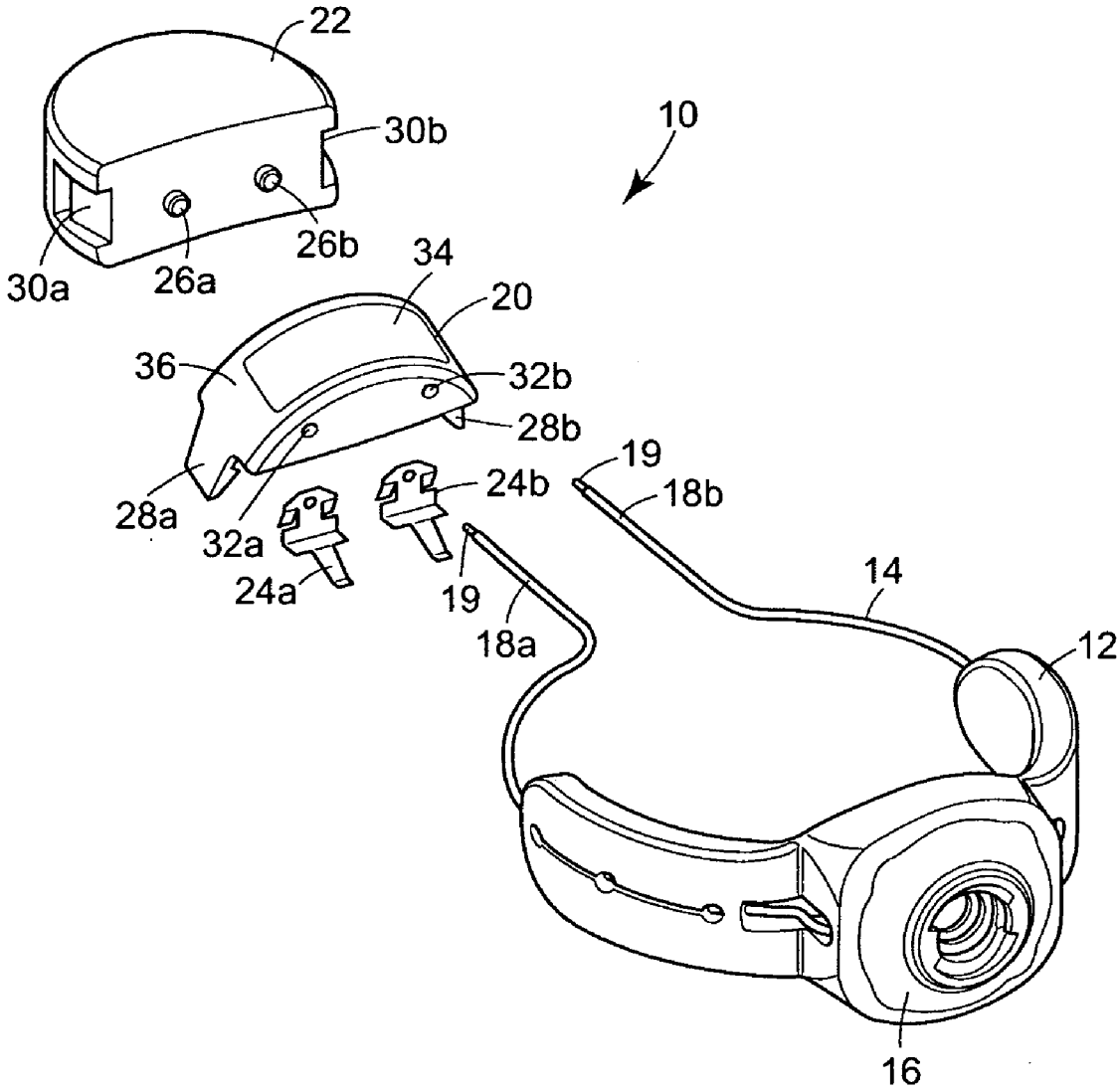
FIG. 2 is a partially disassembled view of the electronic monitoring device shown in FIG. 1.

FIG. 2 shows the electronic monitoring device 10 partially disassembled. The cable 14 includes ends 18*a*, 18*b* that insert into the cap 20. The cap 20 is also adapted to receive a pair of conducting contact springs 24*a*, 24*b*. The contact springs 24*a*, 24*b* engage the cable 14 and electrically couple the cable 14 to the electronic tag 22. In this regard, the cable 14 may include a conductor 19, such as a length of wire that is operable for conducting electrical current. A pair of conducting elements 26*a*, 26*b* formed on the electronic tag 22 is in electrical communication with the contact springs 24*a*, 24*b*, when the electronic tag 22 is connected to the cap 20. The cap 20 further includes a pair of latches 28*a*, 28*b* that flexibly snap fit into a pair of mating slots 30*a*, 30*b* positioned on the electronic tag 22. The latches 28*a*, 28*b* releasably connect the cap 20 to the electronic tag 22 and preferably are not to be easily removed without using a special tool to be described in further detail hereinafter. The ends of the cable 18*a*, 18*b* are inserted through apertures 32*a*, 32*b* formed in the cap 20 and extend into a connection cell 40 (shown in FIG. 4) to the contact springs 24*a*, 24*b*. A cover 34, preferably made of the same material of the band 12, is injected over the top side of the cap 20 into its connection cell 40. The injected material forming the cover 34 also hermetically seals the connection cell 40. In addition, the front side of the cap 20 is curved in order to fit a matching recess in the electronic tag 22. This difference between the front and back sides of the cap 20 is utilized to avoid a polarity mistake during mounting of the cap 20 on the electronic tag 22. The cap 20 could be manually mounted on the electronic tag 22 and no mechanical tool is required.

Figure 3:
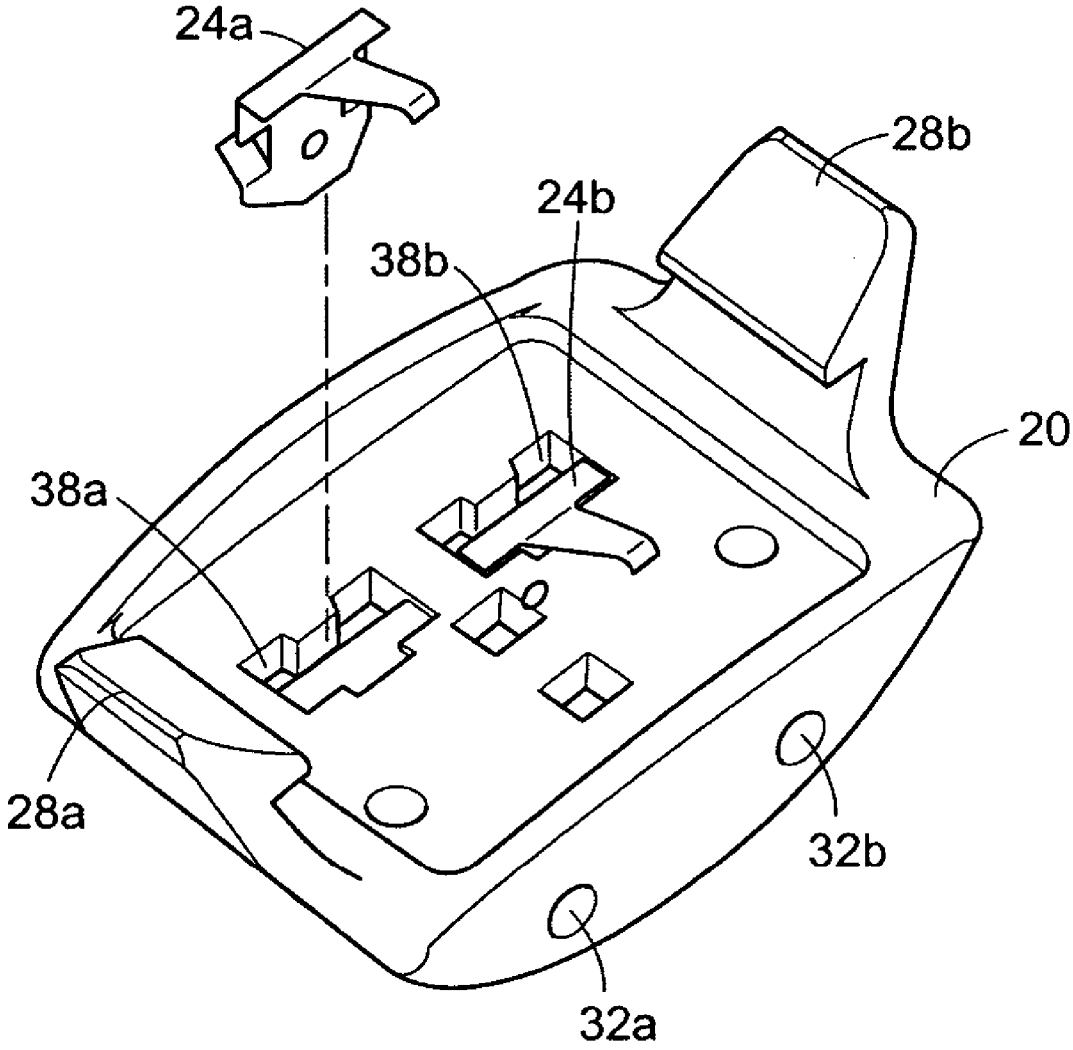
FIG. 3 is a view of a cap having electronic contact springs positioned therein.

Referring now to FIG. 3, a bottom view of the cap 20 shows the position of the contact springs 24*a*, 24*b* when they are assembled into the cap 20. The through apertures 32*a*, 32*b* provide a passageway for the cable ends 18*a*, 18*b* to pass through and connect to the contact springs 24*a*, 24*b*. The contact springs 24*a*, 24*b* are snap fitted into a pair of releasably locking apertures 38*a*, 38*b* and are operable for connecting with the cable 14 (see FIG. 4).

Figure 4:
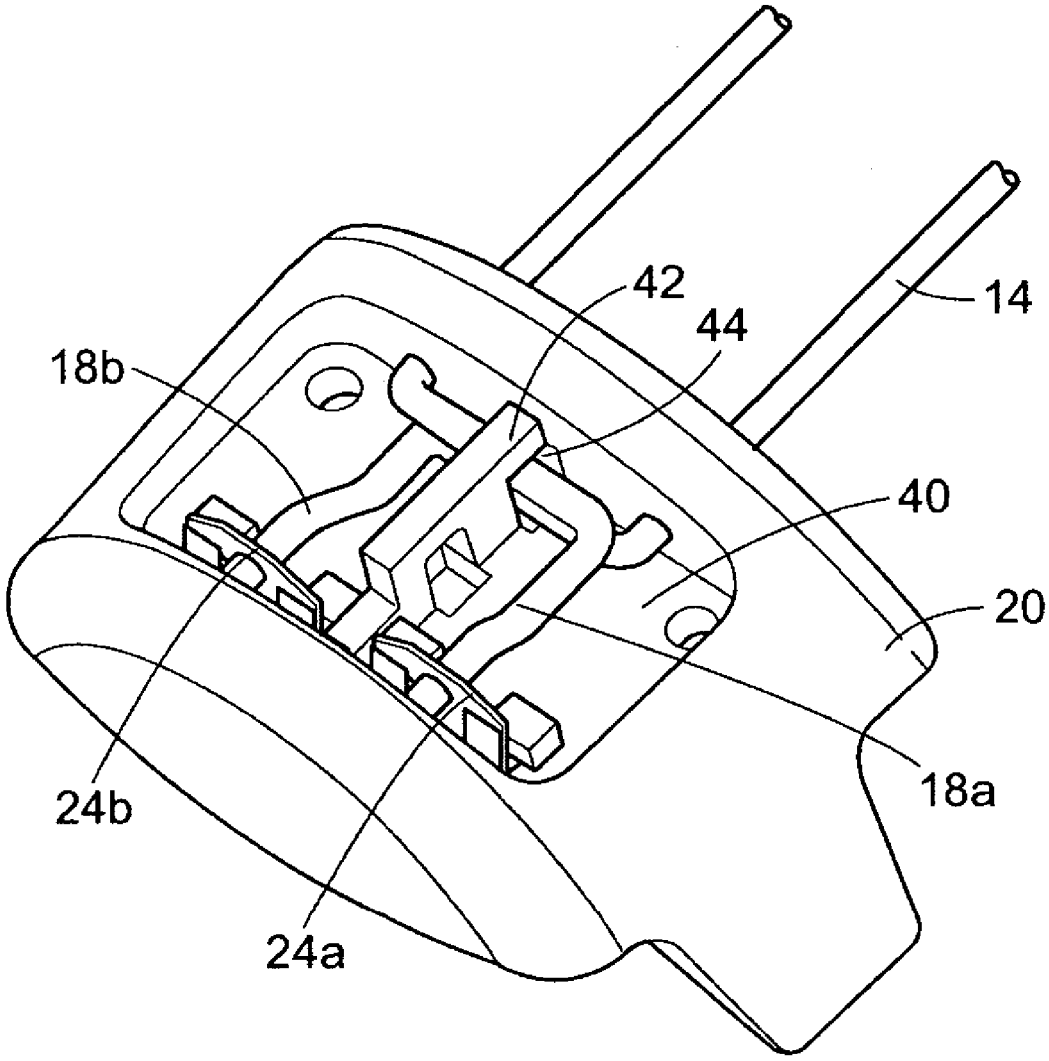
FIG. 4 is a perspective view of the cap shown in FIG. 3, with a cover removed to illustrate the cable being connected to the contact springs inside the cap.

Referring now to FIG. 4, the cap 20 is shown with the cover 34 removed therefrom. The cable 14 is shown extending into the connection cell 40. A support member 42 has at least one through aperture 44 to hold the ends 18*a*, 18*b* of the cable 14 in position such that the ends 18*a*, 18*b* cannot be forcibly removed from engagement with the connecting clips 24*a*, 24*b* by pulling the cable 14 from outside of the cap 20.

Figure 5:
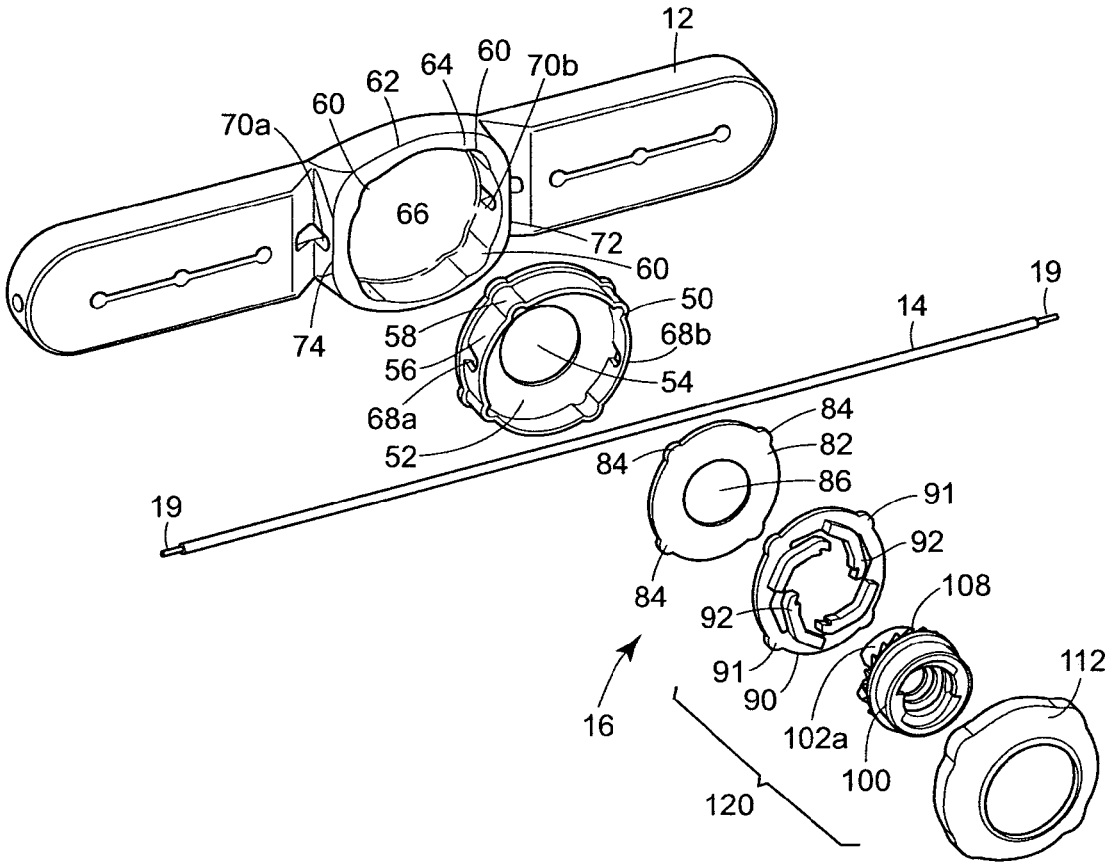
FIG. 5 is a perspective view of a band and winding mechanism assembly shown in exploded form.

Referring now to FIG. 5, the components of the winding mechanism 16 are shown in a disassembled view. The winding mechanism 16 includes a base 50 having a bottom surface 52 with a recessed aperture 54 formed therein. A circumferential rim 56 extends from the bottom surface 52 of the base 50. The circumferential rim 56 may include a plurality of protruding elements 58. The housing 62 of the elastic band 12 includes a perimeter 64 extending upwardly from a floor 66. The perimeter 64 of the housing 62 has a shape that corresponds with a shape of the circumferential rim 56 of the base 50 of the winding mechanism 16. A plurality of notches 60 may be formed in the perimeter 64 of the housing 62. The base 50 is slidingly inserted into the housing 62 such that the protruding elements 58 of the base 50 engage with the corresponding notches 60 in the housing 62 thereby restricting rotational and axial movement of the base 50 with respect to the band 12. The base 50 includes a pair of through holes 68*a*, 68*b* that align with a pair of through holes 70*a*, 70*b* formed in the housing 62 of the band 12. The through holes 68*a*, 68*b* and 70*a*, 70*b* of the housing 62 permit the cable 14 to extend from one side 72 and out the other side 74 of the housing 62.

A substantially flat washer 82 is positioned adjacent the bottom surface 52 of the base 50 keeping the cable 14 ordered between them. The washer 82 includes a plurality of protruding elements 84 that engage with the inner surface of the protruding elements 58 located on the circumferential rim 56 of the base 50. The washer 82 further includes a through aperture 86 formed in the center thereof. A stopper 90 and a rotor 100 form a ratchet-like assembly 120 (in FIG. 5 extend the {to include the stopper 90 and the rotor 100 together as a ratchet 120) that permits the rotor 100 to rotate only in one direction. The stopper 90 includes a plurality of protruding elements 91 that correspond with the protruding elements 58 of the base 50 to prevent the stopper 90 from rotating within the base 50 when the rotor 100 is turned. The stopper 90 and rotor 100 will be further described hereinafter. The cable 14 is drawn through one of the through holes 70*a*, 70*b* of the housing 62 and positioned between the washer 82 and the bottom surface 52 of the base 50. A cover 112 for the winding mechanism 16 is then placed over the assembled components of the winding mechanism 16 and ultrasonic welded with the base 50 to enclose the washer 82, stopper 90, and rotor 100.

Figure 6:
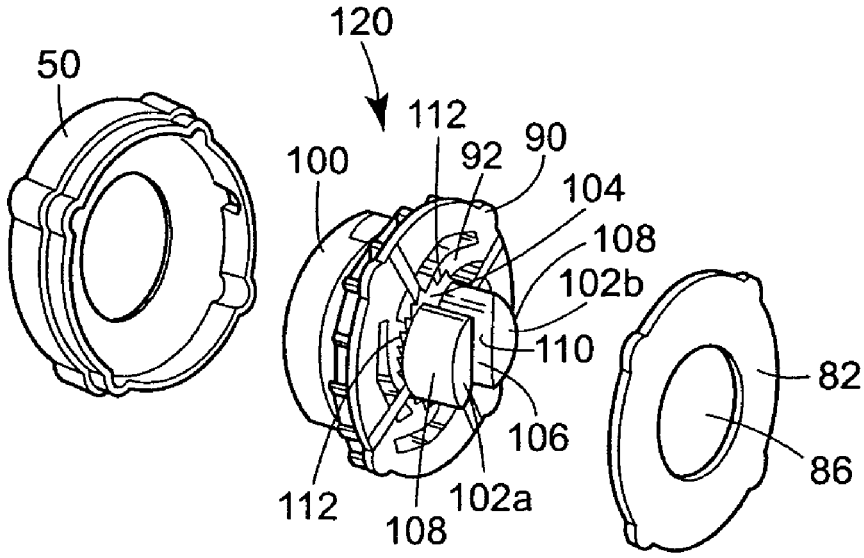
FIG. 6 is a partially exploded view of a portion of the winding mechanism shown in FIG. 5.

Referring now to FIG. 6, the ratchet assembly 120 is shown with the stopper 90 and rotor 100 in an assembled condition. The rotor 100 includes a pair of posts 102*a*, 102*b* that extend outwardly from a forward side 104 of the rotor 100. The posts 102*a*, 102*b* extend substantially parallel to one another and form a channel 106 having a width to correspond with a outside diameter of the cable 14 such that the cable 14 can extend through the channel 106. The posts 102*a*, 102*b* include an arcuate outer surface 108 and a substantially flat inner surface 110. A plurality of teeth 112 extend outwardly from the outer arcuate surfaces 108 at the base of the posts 102*a*, 102*b*. The stopper 90 includes a plurality of arms 92 operable for engaging the teeth 112 of the rotor 100, which will be described in more detail below.

Figure 7:
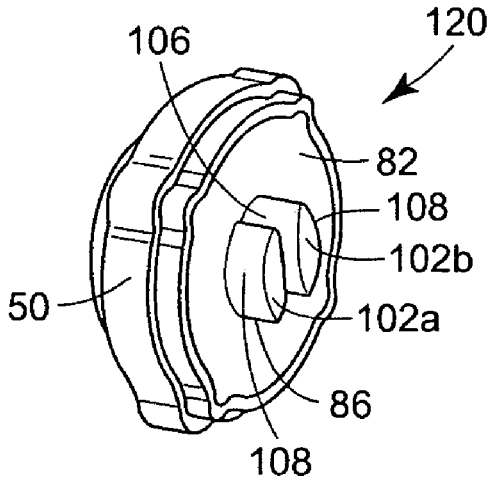
FIG. 7 is an assembled view of a portion of the winding mechanism of FIG. 6.

Referring now to FIG. 7, a perspective view of the ratchet assembly 120 enclosed between the base 50 and the washer 82 is illustrated. The posts 102*a*, 102*b* extend through the center aperture 86 of the washer 82, so as to provide a defined width between the washer 82 and the bottom of the base 50 to wind the cable 14.

Figure 8:
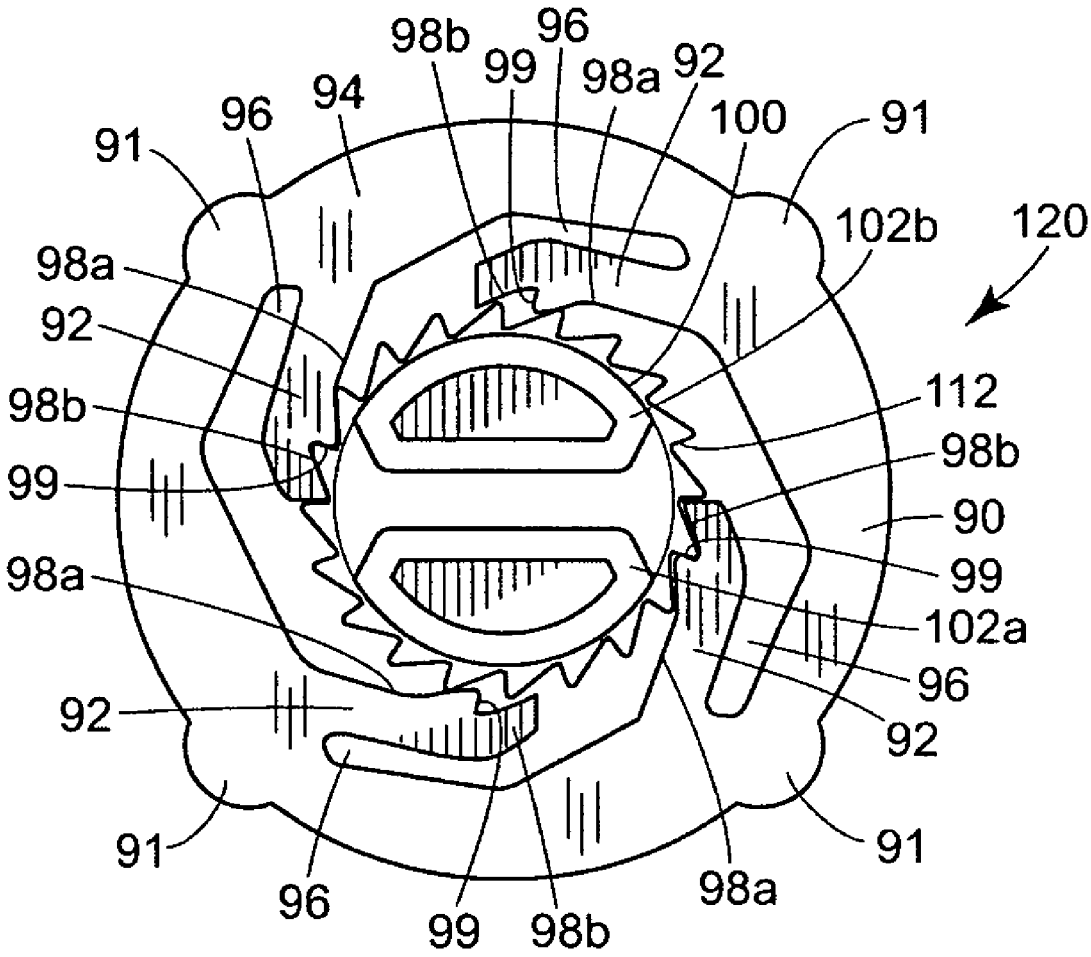
FIG. 8 is an end view of the rotor and stopper assembly shown in FIG. 6.

Referring now to FIG. 8, an end view of the ratchet assembly 120 more clearly illustrates the interface between the rotor 100 and the stopper 90. The stopper 90 includes an outer rim 94 from which a plurality of arms 92 flexibly engage with the teeth 112 of the rotor 100. Each arm 92 includes a cut-away portion 96 formed between the outer rim 94 and each arm 92. The cut-away 96 ensures that each arm 92 is flexible when the rotor 100 is turned in a first direction corresponding to the angle of the teeth 112, but ensures each arm 92 is stiff enough so as not to bend or flex away from the teeth 112 if the rotor 100 is attempted to be rotated in an opposite direction. The geometry of the rotor 100 and stopper 90 teeth 112 is also designed to prevent moving away of the arms 92. Each arm 92 further includes an aft guide surface 98*a* and a forward guide surface 98*b* such that the teeth 112 of the rotor 100 can contact the aft guide surface 98*a* and forward guide surface 98*b* and flex each arm 92 slightly outward when the rotor 100 is rotating in the first direction. A shoulder 99 is formed between the aft guide surface 98*a* and the forward guide surface 98*b* to correspond with the angle of each tooth 112 such that a tooth 112 will butt against the shoulder 99 and not be permitted to rotate in the second direction. The first direction of rotation corresponds to winding the wire of the cable 14 into the winding mechanism 16 and the second direction corresponds with unwinding the cable 14 from the winding mechanism 16. In this manner, the cable 14 cannot be unwound either intentionally or unintentionally. The arms 92 are also staggered so each time only two of them are stopping the rotation back of the rotor 100. This is designed in order to double the angular rotation resolution of the ratchet assembly 120.

Figure 9:
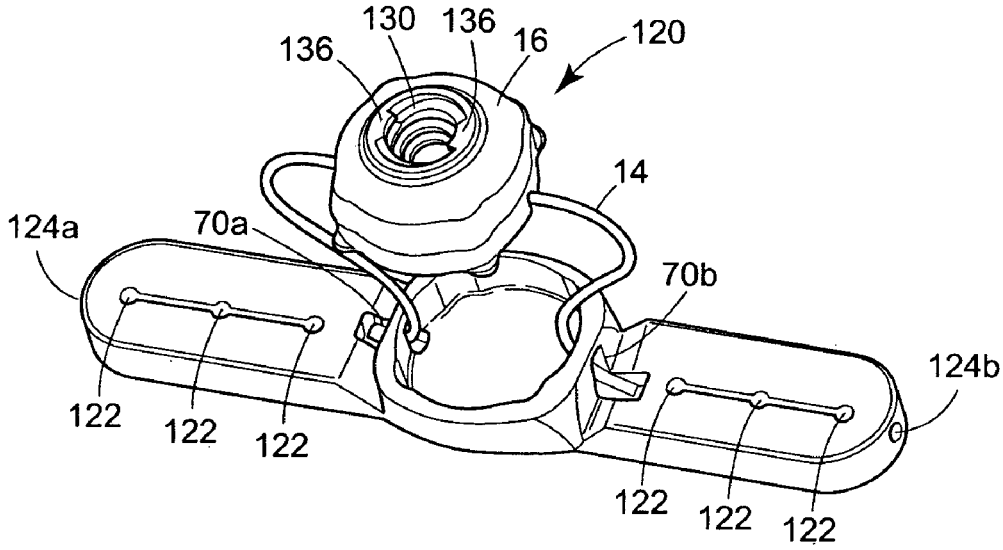
FIG. 9 is a perspective view of the band with the winding mechanism and cable being assembled thereto.
Figure 10:
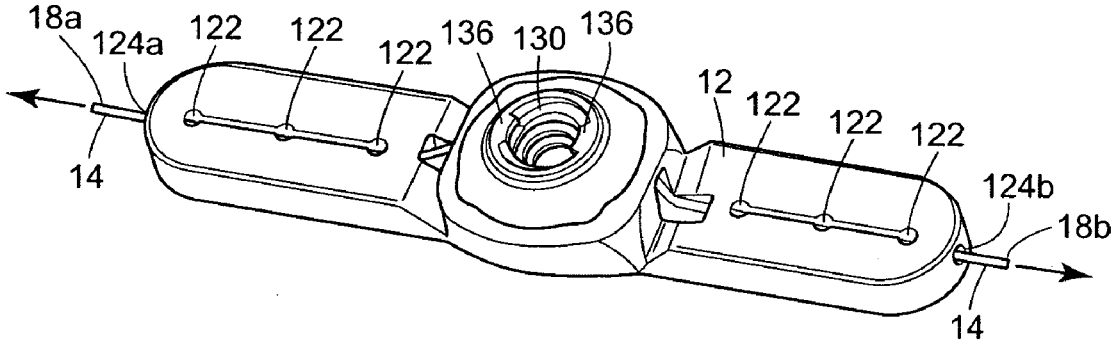
FIG. 10 is an assembled view of the band and winding mechanism of FIG. 9 after the cable has been installed.
Figure 11:
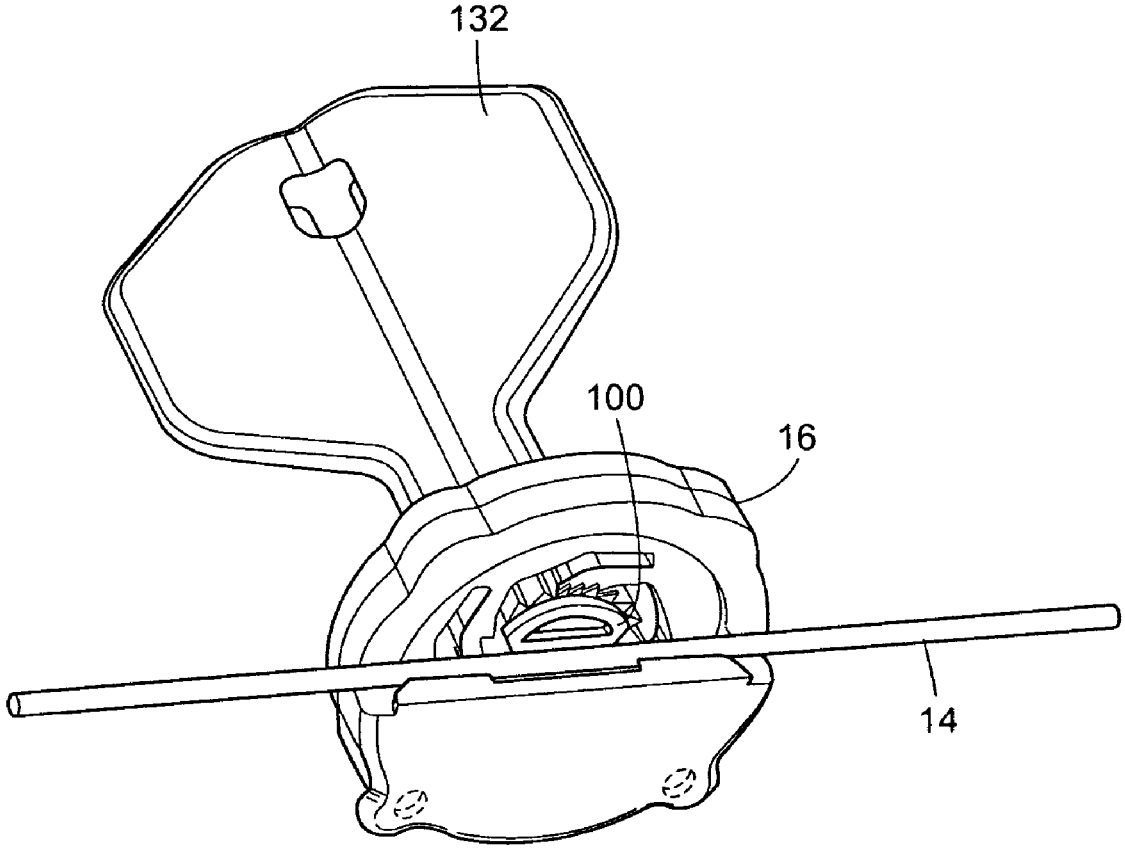
FIG. 11 is a perspective view of a winding mechanism partially cut-away to show the cable positioned therein and a key connected to the winding mechanism.

Referring now to FIGS. 9 and 10, the cable 14 is inserted through the winding mechanism 16 and each end 18*a*, 18*b* is guided out the through holes 70*a*, 70*b* of the elastic band 12. The cable 14 is laced through a plurality of apertures 122 formed in predetermined locations on the band 12 and out an exit aperture 124*a*, 124*b* formed in opposing sides of the band 12. The rotor 100 includes a sloped key way 130 for permitting a key 132 (see FIGS. 11 and 13) having two teeth 134 that slide on the sloped key way 130 to actuate the rotor 100 in the first direction to wind the cable 14 into the winding mechanism 16. At this position the key 132 cannot be separated from the rotor 100 because its teeth 134 are engaged with corresponding rims 136 in the rotor 100. When the key 132 is rotated in the second direction, its teeth 134 slide out of the rotor corresponding rims 136 and the key 132 can be removed from the winding mechanism 16. FIG. 11 shows a cut-away of the winding mechanism 16 with the cable 14 in an initial position prior to being wound up.

Figure 12:
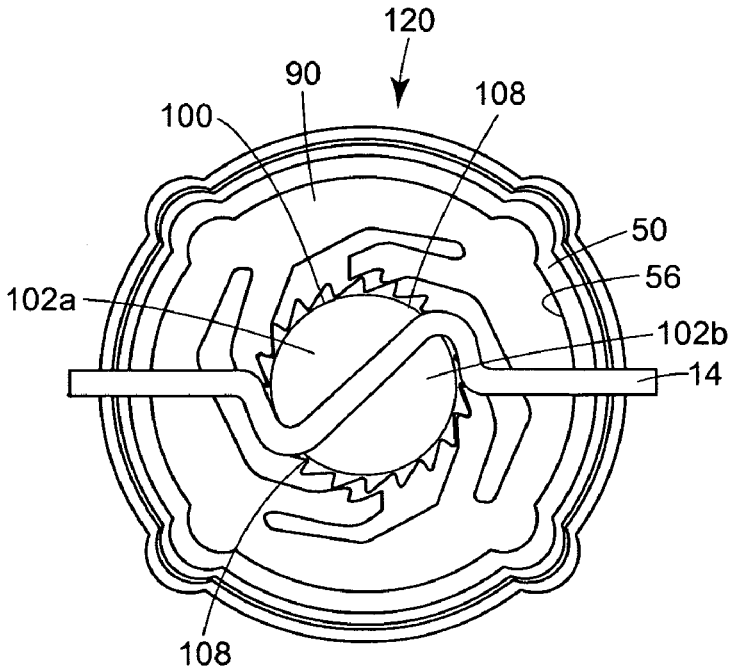
FIG. 12 is an end view of the winding mechanism with a cable beginning to wind around a rotor post.

Referring now to FIG. 12, the end view of the rotor assembly 120 is shown wherein the cable 14 is beginning to wind around the posts 102*a*, 102*b* of the rotor 100. The cable 14 can be wound around the arcuate outer surfaces 108 of the posts 102*a*, 102*b* in a coiled manner until the cable 14 engages the inner surface of the circumferential rim 56 of the base 50 and the winding space is substantially filled with the cable 14.

Figure 13:
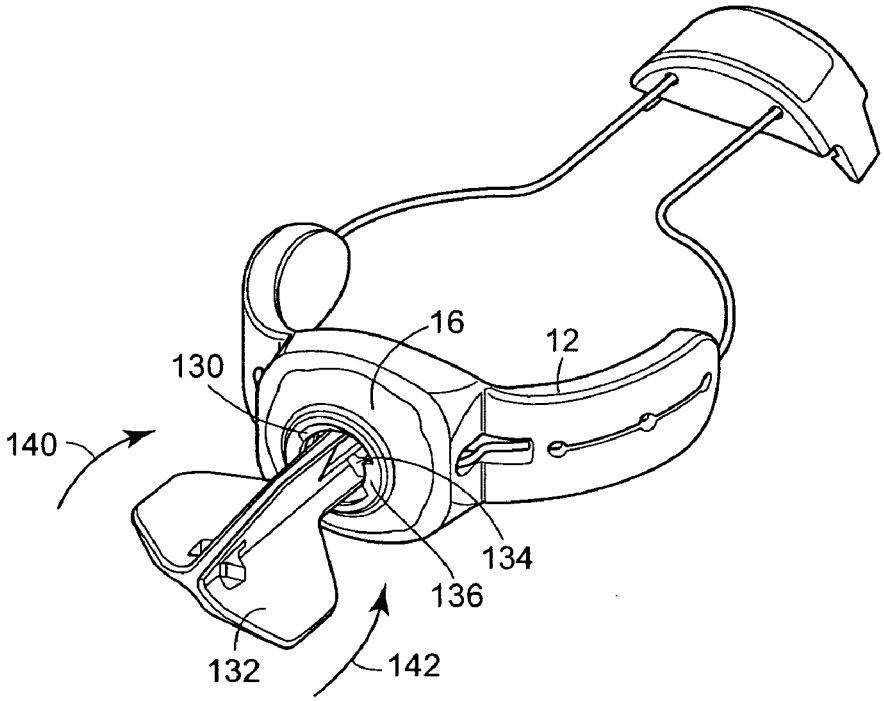
FIG. 13 is a perspective view of a portion of the electronic monitoring device illustrating a key operable for actuating the winding mechanism to wind the cable therein.

Referring now to FIG. 13, when the key 132 is turned in a first direction corresponding with the arrow 140, the cable 14 will wind into the winding mechanism 16 and tighten the band 12 around an object. When the key 132 is rotated in a second direction corresponding with the arrow 142, the key will rotate out of the key way 130.

Figure 14:
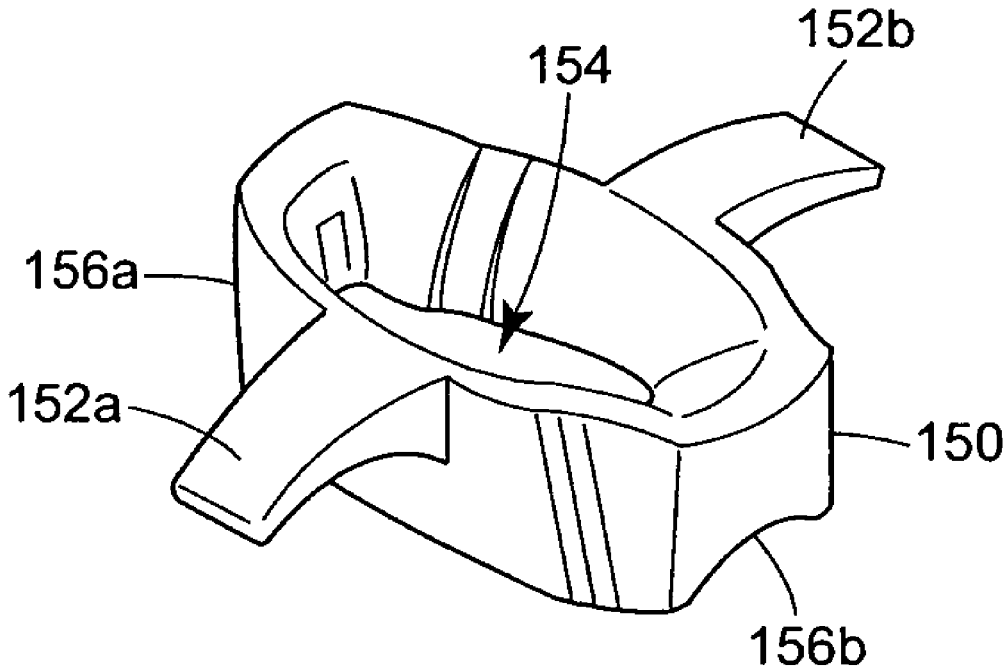
FIG. 14 is a perspective view of an extractor tool operable for removing the cap from the electronic tag.
Figure 14:
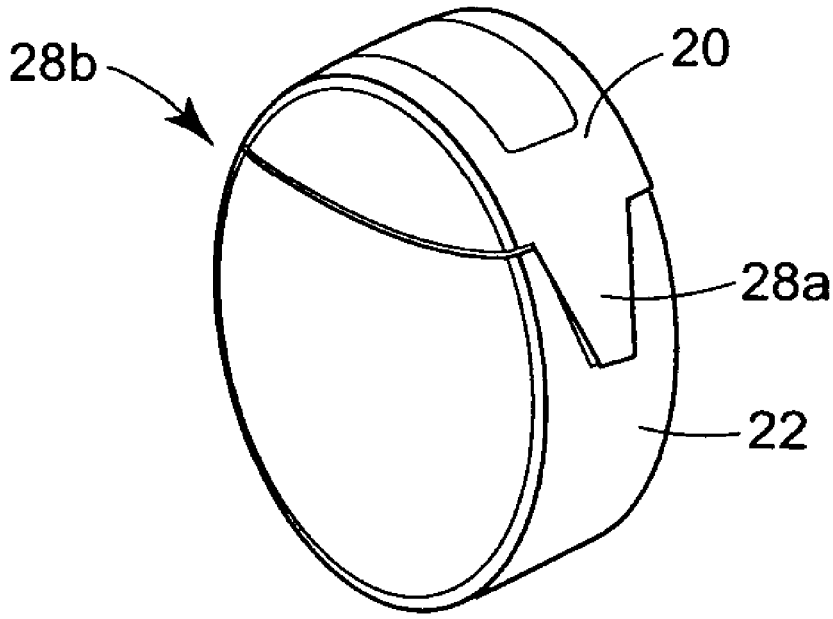

Referring now to FIG. 14, an extractor tool 150 is operable for separating the cap 20 from the electronic tag 22. The extractor tool 150 is placed over the cap 20 and the latches 28*a*, 28*b* are pulled apart from the electronic tag 22. The extractor tool 150 includes a pair of flanges 152*a*, 152*b*. A center aperture 154 shaped substantially similar to the outer shape of the cap 20 and electronic tag 22 is designed to slide over the cap 20. A pair of latch displacing ends 156*a*, 156*b* formed on the extractor tool 150 operably connect with the latches 28*a*, 28*b* of the cap 20 such that when the flanges 152*a*, 152*b* are pulled upon by a user, the extractor tool 150 will pull out the latches 28*a*, 28*b* away from the electronic tag 22.

In operation, the electronic monitoring device 10 includes a kit that should be disposed of after use. The electronic tag 22 is reusable, but the cap 20, clips 24*a*, 24*b*, cable 14, band 12, and winding mechanism 16 should be disposed of after use. These components can be disposed of when sanitary requirements of hospitals or the like dictate such disposal. Only that portion of the electronic monitoring device 10 that contacts an individual is typically disposed of. However, if the monitoring device 10 is used with an inanimate object, then the entire device 10 may be reused as desired. If the device 10 is reused, the winding mechanism 16 must be disassembled and the cable 14 must be replaced.

An operator may place the band 12 with the cap 20 (Disposable Kit) around the object, such as an ankle of a baby and then tighten the band 12 by winding the cable 14 into the winding mechanism 16 using a key 132 as described above. An electronic tag 22 is then attached to the tag 20 which may automatically activate an electronic monitoring system in the facility. The electronic tag 22 may transmit at least one electronic signal and preferably multiple electronic signals used for locating and confirming an operating status of the device 10. The electronic signals can include one of infrared, radio, and low frequency spectrums. The electronic tag 22 further includes a tamper alert feature such that if the cap 20 is removed from the electronic tag 22 without first deactivating the system, an emergency warning is triggered at a monitoring station in the facility. Further, if the cable 14 is cut, an open circuit is detected by the electronic tag 22 and an emergency signal is transmitted from the electronic tag 22 to the monitoring station. The warning signal may include an audible alarm from multiple locations in the facility and from the electronic tag 22 itself. The warning signal may include flashing lights or the like, from monitoring devices mounted to a wall or ceiling of the facility as well as from the device 10 itself.

A second electronic tag may be attached to a second object such as on the mother of the baby so that the two electronic tags 22 may be compared, for matching signals. At least one signal receiver can be located in the facility to detect the electronic tag 22 when the electronic tag 22 is located a predetermined distance from the receiver. The receiver may detect any frequency, but most preferably, includes a frequency defractor. The receivers can be positioned within the building and may be adapted to relay signal transmissions from the electronic tag 22 to a computer server at a monitoring station. The receivers are most prefereably mounted on an upper portion of a wall or ceiling in various locations of the building. The electronic transmissions may include information relating to at least one of relative motion of the electronic device 10, the specific location of the electronic monitoring device 10, the battery life of the electronic tag 22, and error checking such as open circuits caused by cable tampering or the like.

The electronic tag 22 may include a rechargeable battery for the convenience of the user. The electronic tag 22 may also include at least one light emitting diode (LED) formed thereon. In one configuration, a red LED may flash intermittently to show that the voltage of the battery is low and a green LED may flash intermittently to show that the signal transmission of the electronic device 22 is operating in a normal mode. A battery charger may be provided for recharging one or more electronic tags 22 without having to remove the batteries therefrom.

Before the electronic monitoring device 10 can be removed from the monitored object, the system for that particular device 10 should be deactivated so as to prevent an alarm from being triggered. After deactivation, the cable 14 may be cut to permit removal of the band 12 from the object. The cap 20 may then be removed from the electronic tag 22 via the extractor tool 150 as described above. The electronic tag 22 may be reused immediately or after cleaning, sterilization, and recharging of the internal battery as desired.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures as is permitted under law.

What is claimed is:

1. An electronic monitoring device, comprising:

an adjustable length cable connected to an object; and a winding mechanism adapted to wind a desired length of cable into the mechanism, wherein opposing ends of the adjustable length cable are secured in a cap that is separate from the winding mechanism.

2. The electronic monitoring device of claim 1, further comprising:

a band connected to the cable and adapted to engage at least a portion of the object.

3. The electronic monitoring device of claim 1, wherein the cable includes an electrical conducting wire.

4. The electronic monitoring device of claim 1, further comprising:

a pair of contact springs insertable into the cap and adapted to electrically connect the cable to an electronic tag.

5. The electronic monitoring device of claim 4, wherein the electronic tag is operable for transmitting an electronic or electro-optic signal.

6. An electronic monitoring device comprising:

an adjustable length cable connected to an object; and a winding mechanism adapted to wind a desired length of cable into the mechanism, the winding mechanism comprising;

a rotor operable for winding the cable into the winding mechanism when the rotor is rotated in a first direction; and a stopper held in a fixed position relative to the rotor, the stopper operable for permitting the rotor to rotate only in the first direction to prevent the cable from unwinding.

7. The electronic monitoring device of claim 6, wherein the rotor includes a pair of posts having a channel formed therebetween to receive a length of cable therethrough, the posts having arcuate external surfaces for receiving the cable when the cable is wound around the posts.

8. The electronic monitoring device of claim 6, wherein the stopper includes at least one flexible arm extending inwardly from an outer rim.

9. The electronic monitoring device of claim 8, wherein the rotor includes a plurality of teeth extending radially outward at a predetermined angle, the teeth engageable with the at least one arm to permit the rotor to rotate past the at least one arm in the first direction and to prevent the rotor from rotating past the at least one arm in an opposing direction.

10. The electronic monitoring device of claim 6, wherein the rotor includes a key slot operable for permitting a key to engage and rotate the rotor in the first direction.

11. An apparatus for monitoring an object, comprising:

an electronic tag operable for transmitting an electronic or electro-optic signal;

an adjustable length cable connecting the electronic tag to the object; and a winding mechanism operationally connected to the cable and adapted to wind the cable into the winding mechanism, wherein opposing ends of the adjustable length cable are secured in a cap separate from the winding mechanism.

12. The electronic monitoring device of claim 11, further comprising:

a pair of contact springs insertable into the cap and adapted to electrically connect the cable to the electronic tag.

13. The electronic monitoring device of claim 11, wherein the cable includes an electrical conducting wire.

14. The electronic monitoring device of claim 11, further comprising:

an ankle band adapted to engage an ankle of a baby.

15. An electronic monitoring device comprising:

an electronic tag operable for transmitting an electronic or electro-optic signal;

an adjustable length cable connecting the electronic tag to the object; and a winding mechanism operationally connected to the cable and adapted to wind the cable into the winding mechanism, the winding mechanism comprising:

a rotor operable for winding the cable into the winding mechanism when the rotor is rotated in a first direction; and a stopper held in a fixed position relative to the rotor, the stopper operable for permitting the rotor to rotate only in the first direction to prevent the cable from unwinding.

16. The electronic monitoring device of claim 15, wherein the rotor includes a pair of posts having a channel formed therebetween to receive a length of cable therethrough, the posts having arcuate external surfaces for receiving the cable when the cable is wound around the posts.

17. The electronic monitoring device of claim 15, wherein the stopper includes at least one flexible arm extending inwardly from an outer rim.

18. The electronic monitoring device of claim 17, wherein the rotor includes a plurality of teeth extending radially outward at a predetermined angle, the teeth engageable with the at least one arm to permit the rotor to rotate past the at least one arm in the first direction and to prevent the rotor from rotating past the at least one arm in an opposing direction.

19. The electronic monitoring device of claim 15, wherein the rotor includes a key slot operable for permitting a key to engage and rotate the rotor in the first direction.

20. An apparatus for monitoring an object, comprising:

an electronic tag operable for transmitting an electronic or electro-optic signal;

a cap releasably connectable to the electronic tag;

an adjustable length cable connectable to the cap;

a stopper having a rim with at least one flexible arm extending radially inward and at least one protruding element extending radially outward, wherein the at least one protruding element is adapted to prevent the stopper from rotating within a housing; and a rotor operable for winding the cable into the housing, the rotor having a plurality of angled teeth extending radially outward and engagebale with the at least one arm of the stopper to permit rotation of the rotor in a first direction to wind the cable into the housing and prevent the rotor from rotating in an opposite direction to unwind the cable.

21. The apparatus of claim 20, further comprising:

an extraction tool operable for removing the cap from the electronic tag.

22. A method for attaching an electronic monitoring device to an object, comprising the steps of:

placing a band having a cable winding mechanism around the object;

winding a cable in the cable winding mechanism beginning at a portion between ends of the cable;

inserting a key into the cable winding mechanism; and rotating the key in one direction to adjust a cable length.

23. The method of claim 22, further comprising:

rotating the key in an opposite direction from the first direction to remove the key from the winding mechanism.

24. A method for removing an electronic tag from a cap connected to an attaching apparatus, comprising the steps of:

pushing the electronic tag through an aperture formed in an extraction tool until the extractor tool locks into position;

disconnecting locking tabs extending from the cap to the electronic tag; and pulling the electronic tag away from the cap.

* * * * *

UNITED STATES PATENT AND TRADEMARK OFFICE

CERTIFICATE OF CORRECTION

PATENT NO. : 7,292,149 B2
APPLICATION NO. : 11/082115
DATED : November 6, 2007
INVENTOR(S) : Shlomo Yasur et al.

It is certified that error appears in the above-identified patent and that said Letters Patent is hereby corrected as shown below:

At Column 8, line 38, “engagebale” should be -- engageable --.

Signed and Sealed this

Seventeenth Day of June, 2008

JON W. DUDAS
*Director of the United States Patent and Trademark Office*